United States Patent [19]

Roca-Nierga

[11] 4,429,672

[45] Feb. 7, 1984

[54] DEVICE FOR CONTROLLING THE RATE OF DELIVERY OF A FUEL-INJECTION FOR AN INTERNAL-COMBUSTION ENGINE

[75] Inventor: Manuel Roca-Nierga, Barcelona, Spain

[73] Assignee: Spica S.p.A., Leghorn, Italy

[21] Appl. No.: 368,118

[22] Filed: Apr. 14, 1982

[30] Foreign Application Priority Data

Apr. 18, 1981 [DE] Fed. Rep. of Germany ..... 3115720

[51] Int. Cl.[3] ..... F02D 1/06

[52] U.S. Cl. ..... 123/369; 123/383; 123/387

[58] Field of Search ..... 123/369, 383, 387, 386, 123/385, 366, 382

[56] References Cited

U.S. PATENT DOCUMENTS

| | | | |
|---|---|---|---|
| 3,015,326 | 1/1962 | Wirsching et al. | 123/369 |
| 3,033,186 | 5/1962 | Staege et al. | 123/369 |
| 3,726,263 | 4/1973 | Kemp | 123/383 |
| 3,983,849 | 10/1976 | Stumpp | 123/369 |
| 4,286,559 | 9/1981 | Ritter et al. | 123/383 |
| 4,308,834 | 1/1982 | Eheim | 123/369 |
| 4,350,128 | 9/1982 | Boudy | 123/369 |

*Primary Examiner*—Ira S. Lazarus
*Assistant Examiner*—Magdalen Moy
*Attorney, Agent, or Firm*—Diller, Ramik & Wight

[57] ABSTRACT

This invention relates to a device for controlling the rate of delivery of a fuel-injection pump (2) for an internal-combustion engine. The device is composed of a tridimensional planar cam (8) mounted on a slider (40) which is movable axially as a function of the rpm of the pump, the end of stroke depending on the temperature of the engine. The cam (8), moreover, is movable transversely relative to the axis of the slider (40) as a function of a supercharge pressure of the engine.

18 Claims, 2 Drawing Figures

Figure 1:
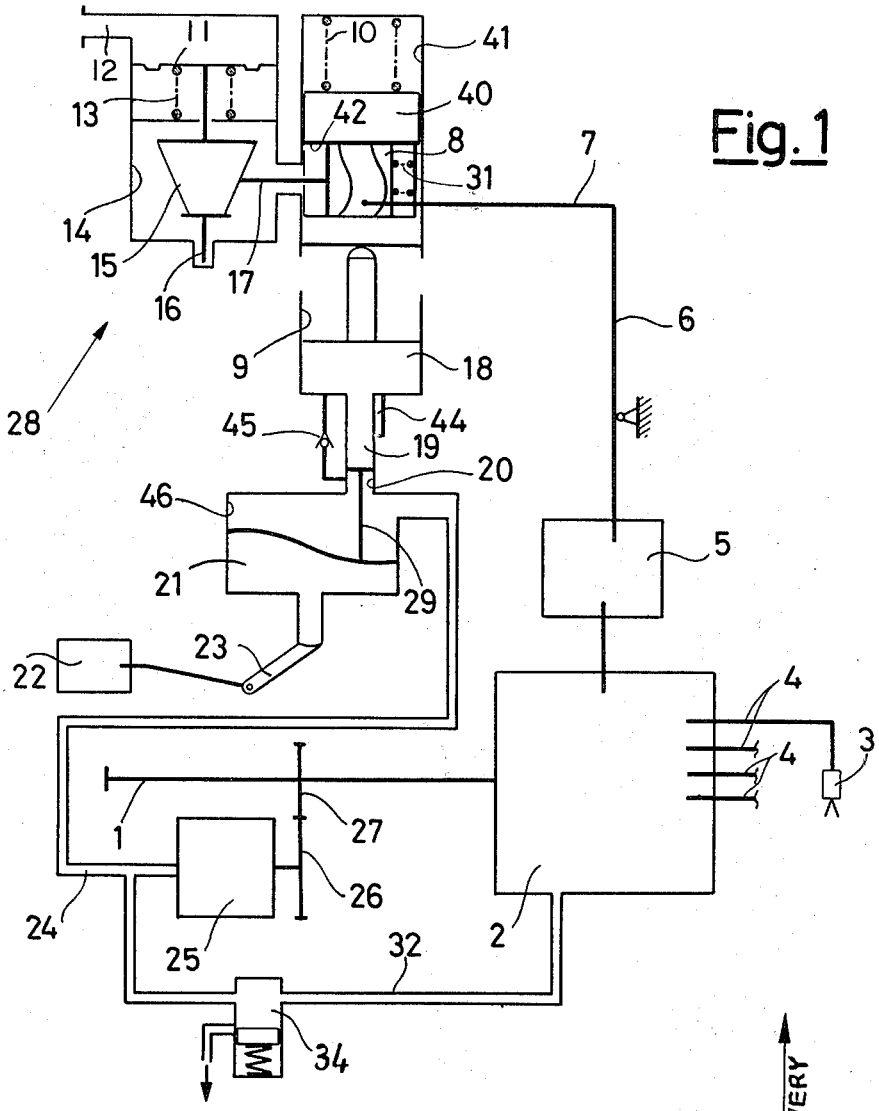

DEVICE FOR CONTROLLING THE RATE OF DELIVERY OF A FUEL-INJECTION FOR AN INTERNAL-COMBUSTION ENGINE

This invention relates to a pump for feeding fuel to an internal-combustion engine of the kind comprising means for pumping and delivering the fuel to the several cylinders, means for controlling the rate of delivery and means capable of bringing about pressures which are a function of the pump rpm.

In order that the efficiency of an internal-combustion engine may be exploited to the utmost, it is necessary that, at every rpm, the maximum possible rate of delivery may be injected but without producing polluting emissions in the exhausts. It is apparent that, for every value of the rpm, there exists a different optimum value for the rate of delivery of the fuel.

Solutions to this problem are known, which permit to carry out a control of the maximum rate of delivery, that is, a control of the torque generated by an engine as fed by the pump, so that, by means of several springs which act upon the regulator of the rate of delivery, there are established, with the aid of centrifugal governors, linear laws of variation which sub-divide the control zones into a number of sections; by so doing, the optimum cannot be obtained but very roughly.

Other approaches permit that a control of the maximum rate of flow may be obtained by a piston having a surface so shaped as to optimize the values at each rotation speed.

Moreover, it is required to adjust the greater volume of fuel which is injected as the engine is being started, on taking also into due account the engine temperature, to prevent the production of black smoke when the engine has already been warmed up, so that it does not require a supplemental fuel delivery to be started.

In addition, when an engine is supercharged, for example by means of a turbo-compressor, the necessity exists of correlating the rate of delivery to the supercharge pressure. Such approaches for the control of the rate of delivery by pistons shaped in their respective surfaces are not capable of giving satisfactory results in order to solve these new problems of the engine construction.

Another known approach provides, to the purpose referred to above, to use a spatial cam having an axial and rotatory motion, for limiting, as a function of the supercharging pressure and the engine rpm as well, the maximum rate of delivery of the fuel.

Such a system is functionally satisfactory, but it is made intricate from the constructional standpoint by the requirement of transferring in polar coordinates, which are proper of a tridimensional cam having a rotary motion, the law of variation of the limitation of the maximum rate of fuel delivery as a function of the engine rpm. In addition, it becomes difficult to replace the cam once the pump and regulator system has been assembled, due to the mechanical connection of the cam to the linkages of the governor.

An object of the present invention is to provide a simple and inexpensive embodiment of a control device, which is capable of overcoming the defects referred to above, while concurrently permitting a control of the maximum optimum rate of delivery at each rpm, and taking also into account the temperature of the engine and the supercharging pressure.

Having this object in view, according to the present invention, a control device has been provided, which is characterized in that the variation of the maximum rate of delivery is carried out by adopting a tridimensional cam of the planar type, on the surface of which a feeler is active, the position of which controls the member which governs the rate of delivery of the fuel. Such a cam is mounted on a slider driven by a piston, the latter being actuated, in its turn, by a pressure which is a function of the rpm of the injection pump, against the bias of return springs so that said cam is shifted in the direction of the longitudinal axis of the slider. The cam, moreover, is actuated in the transversal direction by an element which is responsive to the supercharging pressure of the engine. It is preferred that the piston may rest, at the end of its stroke, against a rotary cam which is driven externally of the pump, by means responsive to the temperature of the internal-combustion engine. The piston may be of the differential cross-section kind in order to make possible to have its motion irreversible once the engine has been started, any possibility being thereby excluded of any accidental return of the piston to its inoperative position.

The adoption of a planar cam makes it possible rapidly to transfer in Cartesian coordinates the laws of variation of the maximum volume of fuel delivered as a function of the supercharging pressure and the engine rpm. In addition, the mode of construction of the cam is considerably simplified.

Lastly, the separation of the planar cam from its supporting slider makes it possible quickly to replace the cam during operation without having to overhaul the governor.

Figure 2:
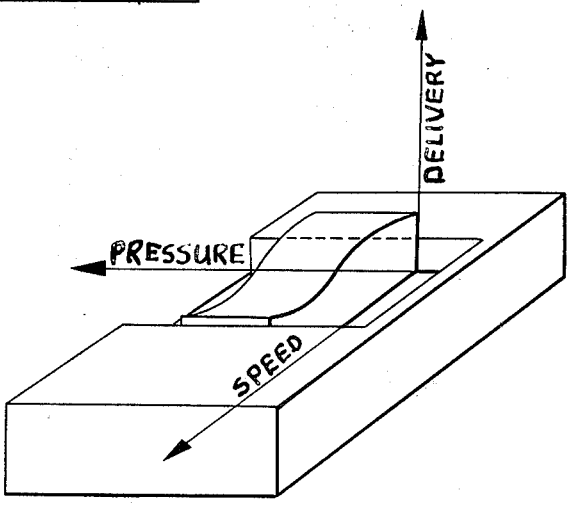

The structural and functional features of the invention and its advantages over the known art will become clearer from a scrutiny of the ensuing exemplary description, aided by the accompanying drawings, wherein:

FIG. 1 is a diagrammatical showing of a device made according to the invention in question, and FIG. 2 is a perspective view of the slider on which the planar tridimensional cam, by which the variation of the rate of delivery of the pump is produced, is mounted.

Having now reference to the drawings, a driving shaft 1, which is rotated synchronously with the engine, drives the conventional injection pump 2, which generates a pressure which is sufficient to inject fuel, via the injection pipes 4 and the injector 3, to the internal-combustion engine concerned.

The rate of flow is regulated by control means 5, also conventional as themselves.

At the same time, and by means of the couple of gears 27, 26 a fuel feed pump 25 is energized which is capable, with known means, of generating a fuel stream having a pressure which is proportional to the rpm or to the square power thereof, or, at any rate, a pressure which is increased as the rpm is increased. This can be effected by the action of a valve 34 which limits the pressure and the outlet of which has a not negligible pressure drop. The delivery branch 32 of the pump 25 is connected by the duct 24 to the chamber 20 in which there is reciprocable a piston 19, which is a smaller diameter extension of a piston 18 which is reciprocable within a cylinder 9. The motion of the piston 19 pushes a slider 40 within its guideway 41 against the bias of springs 10. On the slider 40 there is mounted the planar cam 8, which can be shifted transversally within a corresponding guideway 42 by an element 28 which is responsive to the pressure of supercharging of air to the engine, through the linkage 17 and against the bias of a spring 31. The element 28 comprises a cone 15 which can be shifted while being guided by the axle 16 in the chamber 14 and is connected to a diaphragm 11 whereon the supercharging pressure, coming from 12 may act against the bias of a return spring 13. The conduit 12 can be connected to the induction conduit of the engine.

The feeler 7, connected to the delivery-control means 5 through the lever 6, rests against the cam 8 perpendicularly to both the movements of the latter, namely the longitudinal motion relative to the slider 40 and the piston 18, and transversal due to the action of the element 28.

A stem 29, connected to the piston 19, rests against the surface of a cam 21 which is contained in the seat 46 and which can be rotated from the outside by a lever 23 by means of an element 22 responsive to the engine temperature.

It should be noticed that, in the wall of the chamber 20 within which the piston 19 is reciprocable, a longitudinal recess 44 is formed, which mutually connects the chamber 20 to the space defined by the piston 18 in the cylinder 9. Consequently the pressure obtaining in the chamber 20 acts only upon the piston 19 until the latter has travelled over a first stroke which unmasks the passageway 44, so that such a pressure is equally active upon the annular surface of the piston 18.

The return of the piston 18 to its inoperative position is made possible by the unidirectional valve 45, or merely by the seepings between the piston 19 and its cylinder.

The stroke of the piston 19 which unmasks the passageway 44 will preferably be longer than the maximum lift of the cam 21, in order that, for any position of such cam at the engine start, only the piston 19 may be exposed to the pressure of the fluid fed by the piping 24.

The rotation of the injection pump 2 by the shaft 1 also actuates the feed pump 25 which generates a pressure which is proportional to the rpm or to its square power, said pressure reaching through the duct 24 the chamber 20 and acting first upon the piston 19 and subsequently also upon the piston 18, as outlined above. This movement, which is thus proportional to the rpm, displaces the slider 40 and the planar cam 8, which latter may also receive a transversal motion as controlled by the element 28 which is responsive to the supercharging pressure, the latter being introduced through the conduit 12. In this manner, the spatial position of the cam 8 is a function both of the speed and the supercharging pressure.

The surface of the planar cam 8 is sensed by the feeler 7 which, via the lever 6, regulates the rate of flow by conventional control means 5.

When the pump 25 is at standstill, the action of the spring 10 compels, inasmuch as no pressure obtains within the chamber 20, the stem 29 to rest against the surface of another cam 21, which, by the agency of external means 22, has a position which depends of the engine temperature.

According to whether the engine is cold or warm, different angular positions are obtained from the cam 21, which can appropriately be shaped, thus permitting different end positions of the piston 18 and thus of the cam 8 connected thereto. By varying the cam profile, the maximum rate of delivery generated by the control means 5 is varied by the cam 8 and the levers 7 and 6.

As a matter of fact, by properly shaping the planar tridimensional cam 8, one obtains different laws of variation of the maximum unitary rate of delivery of the injected fuel, as a function of both the rpm and the feeding pressure.

Furthermore, by properly shaping the cam 21, starting rates of flow can be obtained, which differ consistently with the engine temperature.

The example given herein was related to the control of the cam shift as a function of the engine rpm as controlled by the pressure which is generated between the feed pump 25 and the injection pump 2. However, the cam shift as a function of the engine rpm can also be obtained otherwise, by functionally equivalent means, such as disclosed, for example, in a copending application by the present applicants.

Other changes in the component parts of the control device described above can be introduced by anyone skilled in the art without departing from the scope of this invention.

I claim:

1. A controlled device for an internal combustion engine comprising pump means for generating fuel pressure which is proportional to the rpm's of an internal combustion engine, means for delivering fuel to injectors of an internal combustion chamber, means for developing supercharging pressure for an internal combustion engine, means for controlling said fuel delivering means in response to fuel pressure and supercharging pressure, said controlling means including a tridimensisonal planar cam, means for mounting said cam for sliding movement in two directions perpendicular to each other in a common plane, means for moving said cam in a first of said two directions in response to the generated fuel pressure, first means for biasing said cam in a direction opposite to said first direction against the force of the generated fuel pressure, means for moving said cam in a second of said two directions in response to the supercharging pressure, second means for biasing said cam in a direction opposite to said second direction, and means for responding to cam movement in both of said two directions for operating said fuel delivering means.

2. The controlled device as defined in claim 1 wherein said second direction cam moving means includes a diaphragm biased by said second biasing means in a direction against the supercharging pressure, a conical member carried by said diaphragm, and said second direction cam moving means including an element between said cam and said cone which reacts to cone movement to said cam in said second direction.

3. The control device as defined in claim 1 including means for establishing a home position for said cam relative to said first direction of travel indicative of minimal rpm's.

4. The control device as defined in claim 1 including means for establishing a home position for said cam relative to said first direction of travel indicative of minimal rpm's and also responsive to engine temperature.

5. The control device as defined in claim 1 including means for establishing a home position for said cam relative to said first direction of travel indicative of minimal rpm's and also responsive to engine temperature, said home establishing means including a cam, and means for moving said last-mentioned cam in response to engine temperature to thereby move said tridimensional planar cam to a position compensating for engine temperature.

6. The control device as defined in claim 1 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam.

7. The control device as defined in claim 1 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, and said coupling means including a rod portion carried by and projecting from said piston.

8. The control device as defined in claim 1 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, said piston being a differential piston having first and second respectively larger and smaller piston portions received in respective first and second respectively larger and smaller cylinder portions of said fluid cylinder, said one piston side being a side of said smaller piston portion, and means for fluid coupling said first and second fluid cylinder chamber portions only after said second smaller piston portion has moved a predetermined distance in said second smaller fluid cylinder portion.

9. The control device as defined in claim 2 including means for establishing a home position for said cam relative to said first direction of travel indicative of minimal rpm's.

10. The control device as defined in claim 2 including means for establishing a home position for said cam relative to said first direction of travel indicative of minimal rpm's and also responsive to engine temperature.

11. The control device as defined in claim 2 including means for establishing a home position for said cam relative to said first direction of travel indicative of minimal rpm's and also responsive to engine temperature, said home establishing means including a cam, and means for moving said last mentioned cam in response to engine temperature to thereby move said tridimensional planar cam to a position compensating for engine temperature.

12. The control device as defined in claim 2 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam.

13. The control device as defined in claim 2 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, and said coupling means including a rod portion carried by and projecting from said piston.

14. The control device as defined in claim 2 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, said piston being a differential piston having first and second respectively larger and smaller piston portions received in respective first and second respectively larger and smaller cylinder portions of said fluid cylinder, said one piston side being a side of said piston portion and means for fluid coupling said first and second fluid cylinder chamber portions only after said second smaller piston portion has moved a predetermined distance in said second smaller fluid cylinder portion.

15. The control device as defined in claim 3 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam.

16. The control device as defined in claim 3 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, and said coupling means including a rod portion carried by and projecting from said piston.

17. The control device as defined in claim 3 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam, said piston being a differential piston having first and second respectively larger and smaller piston portions received in respective first and second respectively larger and smaller cylinder portions of said fluid cylinder, said one piston side being a side of said smaller piston portion and means for fluid coupling said first and second fluid cylinder chamber portions only after said second smaller piston portion has moved a predetermined distance in said second smaller fluid cylinder portion.

18. The control device as defined in claim 9 wherein said first direction cam moving means includes a fluid cylinder and a piston mounted for sliding movement in said fluid cylinder, means for exerting the fuel pressure against one side of said piston, and means for coupling an opposite side of said piston to said tridimensional planar cam.

* * * * *